US006230716B1

(12) United States Patent
Minoletti

(10) Patent No.: US 6,230,716 B1
(45) Date of Patent: May 15, 2001

(54) HAIRBRUSH WITH REMOVABLE HANDLE AND HAIRBRUSH SYSTEM UTILIZING THE SAME

(76) Inventor: Luigi Minoletti, 6 Winslow Rd., New London, NH (US) 03257

( * ) Notice: Subject to any disclaimer, the term of this patent is extended or adjusted under 35 U.S.C. 154(b) by 0 days.

(21) Appl. No.: 09/234,550

(22) Filed: Jan. 21, 1999

(51) Int. Cl.[7] ..... A45D 2/12; A45D 24/16; A46B 29/17

(52) U.S. Cl. ..... 132/226; 132/120; 15/176.1; 15/176.6

(58) Field of Search ..... 132/226, 120, 132/223, 265, 262, 122, 150, 200, 266, 267, 238, 239, 313; 15/145, 176.1, 176.6, 144.4

(56) References Cited

U.S. PATENT DOCUMENTS

| | | | | |
|---|---|---|---|---|
| D. 324,454 | * | 3/1992 | Herron | D4/100 |
| 2,458,426 | * | 1/1949 | Rosiello | 132/19 |
| 3,083,715 | * | 4/1963 | Trabish | 132/120 |
| 3,421,522 | * | 1/1969 | Magguilli | 132/120 |
| 3,894,549 | * | 7/1975 | Scivoletto | 132/120 |
| 3,967,630 | * | 7/1976 | Zuhlsdorff et al. | 15/167.1 |
| 3,991,776 | * | 11/1976 | Duffy | 132/226 |
| 4,605,023 | * | 8/1986 | Modin | 132/226 |
| 4,712,570 | * | 12/1987 | Caccioppo | 132/40 |
| 4,811,445 | * | 3/1989 | Lagieski | 15/176.1 |
| 5,247,716 | * | 9/1993 | Bock | 15/167.1 |
| 5,361,446 | * | 11/1994 | Rufo | 15/167.1 |
| 5,471,701 | * | 12/1995 | Parfenie | 15/167.1 |
| 5,479,951 | * | 1/1996 | Denebeim | 132/265 |
| 5,603,339 | * | 2/1997 | Brazeal et al. | 132/119.1 |
| 5,737,792 | * | 4/1998 | Quigless | 15/167.1 |
| 5,749,115 | * | 5/1998 | Franke | 15/176.6 |
| 5,992,423 | * | 1/1999 | Tevolivi | 132/200 |

* cited by examiner

*Primary Examiner*—Gene Mancene
*Assistant Examiner*—Robyn Kieu Doan
(74) *Attorney, Agent, or Firm*—Michael J. Persson; Lawson, Philpot & Persson, P.C.

(57) ABSTRACT

A hairbrush having a head that may be quickly removed from the brush handle and a hairbrush system utilizing the same. In its most basic form, the hairbrush includes a brush head having a plurality of bristles, a removable brush handle, and a quick disconnect mechanism for removably attaching the brush handle to the brush head such that the brush handle may be quickly removed from the brush head. In the preferred embodiment, the quick disconnect mechanism includes a rod extending from the brush handle with a spring loaded ball partially extending from the rod, and an opening disposed within the brush head for accepting the rod and retaining the ball. The preferred ball presses against a sleeve disposed within the opening in the brush head. In some embodiments, however, the sleeve is eliminated and the opening includes a keyway and retainer mates with the ball and holds the ball in place. The hairbrush system includes two or more cylindrical brush heads, at least one brush handle and a quick disconnect mechanism, each as described above. In the preferred system, at least two of the cylindrical brush heads are of different diameter.

13 Claims, 4 Drawing Sheets

HAIRBRUSH WITH REMOVABLE HANDLE AND HAIRBRUSH SYSTEM UTILIZING THE SAME

FIELD OF THE INVENTION

The present invention relates to the field of brushes and, in particular, to a hair brush having a removable handle.

BACKGROUND OF THE INVENTION

In the field of hairdressing, it is often desirable to roll a client's hair about a plurality of cylinders while the hair is damp and subsequently drying the hair while it is still in its rolled state. Such a rolling and drying results in dressed hair having a fuller appearance and enhanced body.

Currently, there are two principal methods for rolling and drying hair. The first involves the use of a hairbrush to brush the hair and a separate cylindrical roller to roll the hair and hold it in the desired position. The second involves brushing and rolling the hair with a plurality of substantially cylindrical brushes having fixed handles extending from one end of the base of the cylinder. Each of these methods allows the hair to be brushed and rolled while the hair is wet and to subsequently hold the hair in position during drying. However, each of these methods has significant drawbacks.

The use of a hairbrush to brush the hair and separate cylindrical rollers to roll the hair and hold it in the desired position requires careful coordination of both hands of the hairdresser to allow the hair to be brushed and held and, at the same time, the roller to be manipulated to allow the hair to be rolled. Added to this is the need for the hairdresser to put down the hairbrush with one hand, while holding the rolled hair with the other, in order to pin or clip the hair to the roller. If any of the rolled hair is not held by the clip, the roller must be removed and the process begun again. In addition, once the rolled hair is successfully pinned or clipped, the pressure on the wet hair exerted by the clips used to hold the rollers in place will often leave a wave in the hair at the contact point between the clip and roller when the hair is dried. Therefore, there is a need for a means for rolling hair to be dried that avoids the coordination problem attendant to the use of a separate hairbrush and roller, that does not require re-rolling if all of the rolled hair does not stay in place during rolling, and that does not utilize clips that may leave waves in the dried hair.

The use of a plurality of cylindrical hairbrushes to brush the hair, roll the hair and to hold the hair in place overcomes the drawbacks of the hairbrush and separate roller method. In this method, the cylindrical hairbrush may be held in one hand while the hair is manipulated by the other hand, avoiding the coordination problems discussed above. Once brushed and rolled, the hair is effectively held within the bristles of the brush without the use of pins or clips that may leave a wave in the hair. Finally, any hair which does not stay in place during the initial rolling may be subsequently wrapped around the brush without requiring the hair to be unrolled, re-brushed, and re-rolled.

Despite its advantages over the hairbrush and roller method, one major drawback of this method is that the extension of fixed handles from the brushes that have already been affixed to the head interferes with the subsequent brushing and rolling of the remainder of the hair. This interference may prevent the hair adjacent to the handles from being adequately brushed and rolled. In addition, the handle of one brush is likely to press down on hair held by an adjacent brush, causing waves in a similar manner to those caused by pins or clips. Therefore, there is a need for a hairbrush that does not include a fixed handle that will interfere with the brushing and rolling of other portions of the hair and press down on hair rolled about an adjacent brush.

A number of patents have been issued in the field of hairbrushes. However, these hairbrushes either fail to overcome the drawbacks attendant to fixed handle hairbrushes, or have significant drawbacks of their own.

U.S. Pat. No. 4,605,023, titled "Hairstyling Brush and a Method for Handling Hairstyling Brushes", discloses a hairstyling brush having a removable apparatus for handling the brush. The handling apparatus includes a cylindrical reservoir, that mates with an open shank of the brush, and a biasing latch to connect and disconnect the handling apparatus from the brush. The hairbrush of this patent does not overcome the problems attendant to fixed handle hairbrushes as the open shank of the brush is not removable and extends from the area where the bristles are disposed.

U.S. Pat. No. 5,749,115, titled "Rotatable Head Hairbrush", discloses a hairbrush having an elongated, generally hollowed, handle having a receiving cavity and a separate brush head having a connection end. When assembled, the arrangement of the handle and connection end of the hairbrush allow the brush head to rotate a predetermined distance about the handle. The hairbrush of this patent does not overcome the problems attendant to fixed handle hairbrushes as the connection end of the brush head is not removable and extends from the area where the bristles are disposed.

U.S. Pat. No. 4,500,939, titled "Hair Brush with a Flexible Base Plate Made of a Plastic Material", discloses a hairbrush system having a variety of means for attaching the head to the brush. However, this brush is intended to have a stationary head and, hence, none of the disclosed handles is quickly or easily removable.

Finally, U.S. Pat. No. 5,749,115, titled "Bendable, Extendable Hairbrush With Removable Brush Head", discloses a hairbrush system with a bendable, extendable handle and a removable brush head. In some embodiments of this brush system, the head is adapted to brush and roll the hair and then be completely removed from the handle. However, this brush system is difficult to use as the bayonet and screw systems for attaching the handle to the brush does not provide a way to remove the handle quickly and without exerting a significant force to the brush. Therefore, there is a need for a brush having a handle that may be quickly removed without the exertion significant force on the hairbrush.

A hairbrush and hairbrush system that avoids the coordination problem attendant to the use of a separate hairbrush and roller, that does not require re-rolling if all of the rolled hair does not stay in place during rolling, that does not utilize clips that may leave waves in the dried hair, that does not include a fixed handle that may interfere with the brushing and rolling of adjacent hair, and is quickly and easily removed without the application of significant force, is not known in the art.

SUMMARY OF THE INVENTION

The present invention is a hairbrush having a head that may be quickly removed from the brush handle and a hairbrush system utilizing the same. In its most basic form, the hairbrush includes a brush head having a plurality of bristles, a removable brush handle, and a quick disconnect mechanism for removably attaching the brush handle to the brush head such that the brush handle may be quickly removed from the brush head. In the preferred embodiment, the quick disconnect mechanism includes a rod extending from the brush handle with a spring loaded ball partially extending from the rod, and an opening disposed within the brush head for accepting the rod and retaining the ball. The preferred ball presses against a sleeve disposed within the opening in the brush head. In some embodiments, however, the sleeve is eliminated and the opening includes a keyway and retainer that mate with the ball and hold the ball in place. The hairbrush system includes two or more cylindrical brush heads, at least one brush handle and a quick disconnect mechanism, each as described above. In the preferred system, at least two of the cylindrical brush heads are of different diameter.

Therefore, it is an aspect of the invention to provide a hairbrush and hairbrush system that avoids the coordination problem attendant to the use of a separate hairbrush and roller.

It is a further aspect of the invention to provide a hairbrush and hairbrush system that does not require re-rolling if all of the rolled hair does not stay in place during rolling.

It is a further aspect of the invention to provide a hairbrush and hairbrush system that does not utilize clips that may leave waves in the dried hair.

It is a further aspect of the invention to provide a hairbrush and hairbrush system that does not include a fixed handle that may interfere with the brushing and rolling of adjacent hair.

It is a further aspect of the invention to provide a hairbrush and hairbrush system that is quickly and easily removed without the application of significant force.

It is a still further aspect of the invention to provide a hairbrush system that may utilize a plurality of cylindrical brush heads of different diameters.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE DRAWINGS

Figure 1:
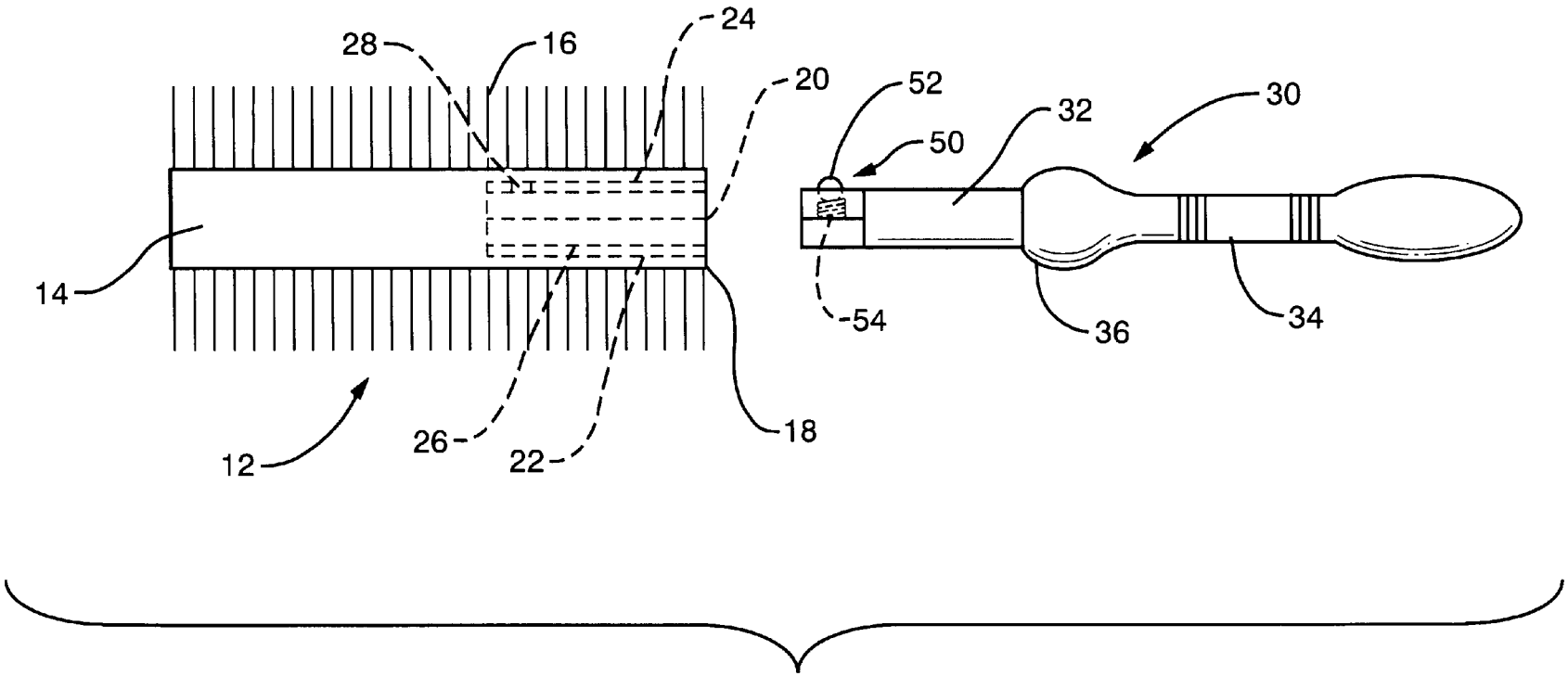
FIG. 1 is a side view of the preferred embodiment of the hairbrush of the present invention with a portion cut away to reveal the quick disconnect mechanism.

Referring first to FIG. 1, the preferred embodiment of the hairbrush of the present invention is shown. The hairbrush 10 includes a brush head 12, a removable brush handle 30, and a quick disconnect mechanism 50 for quickly disconnecting the brush handle 30 from the brush head.

Brush head 12 includes a base 14 and a plurality of bristles 16 attached the base 14. As shown in FIG. 1, brush head 12 is substantially cylindrical. However, brush heads 12 of other shapes are also contemplated and may be substituted so long as the resulting brush head 12 is capable of rolling and holding the hair during drying. Base 14 of brush head 12 includes a handle end 18 into which an opening 20 is disposed and a sleeve 22 dimensioned for insertion within the opening 20. In the preferred embodiment, sleeve 22 has a substantially cylindrical outer surface 24 that is secured to the inner walls of opening 20 and a squared inside surface 26 to prevent rotation of the brush head 12 during use. In addition, the preferred sleeve 22 includes a hole 28 dimensioned to accept a ball 52, which forms a part of the quick disconnect mechanism 50, to prevent inadvertent removal of the brush handle 30 from the brush head 12.

Brush handle 30 includes a handle 34 having a brush end 36 and a rod 32 that extends from the brush end 36 of the handle 34. Handle 34 may be made of any material and have any cross-section commonly utilized in the hairdressing arts, although it is preferred that handle 34 be made of wood. Rod 32 extends a predetermined distance from the brush end 36 of the handle 34 and is dimensioned to mate with the sleeve 22 secured within the opening 20 of brush head 12.

In the preferred embodiment, the quick disconnect mechanism 50 includes a ball 52 that is embedded within the rod 32. The ball 52 is held in position by a spring 54, which exerts an upward force upon the ball 52 such that when the rod 32 is inserted within opening 20 in brush head 12 the ball 52 is depressed until it reaches the hole 28 in sleeve 22, whereupon it extends to fill the space voided by the hole 28. In this manner, rotation of the brush head 12 and inadvertent withdrawal of the brush handle 30 are prevented while allowing the brush handle 30 to be quickly withdrawn at a desired time.

Figure 2:
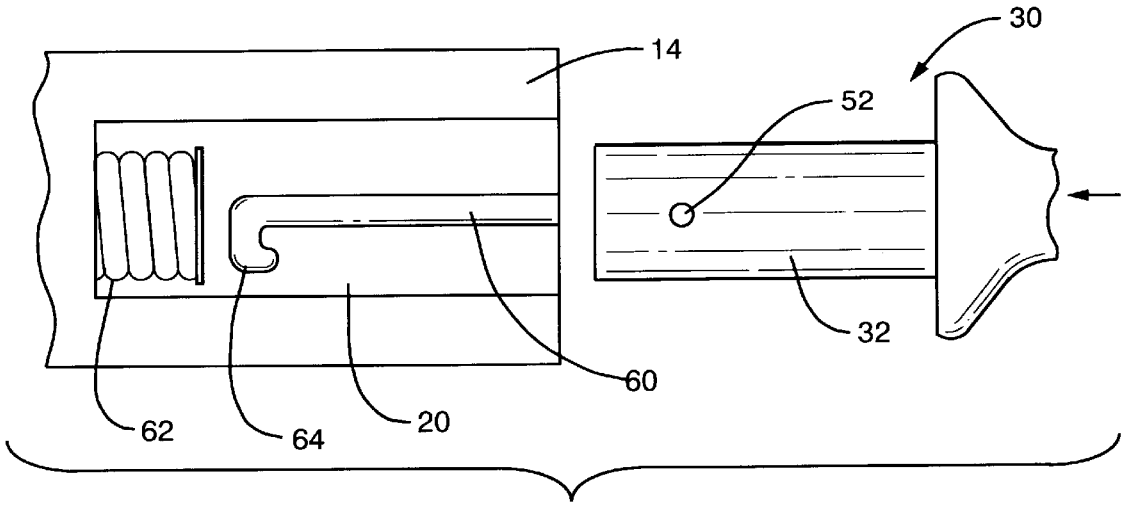
FIG. 2 is a cut away side view of another embodiment of the hairbrush of the present invention before insertion of the rod into the opening of the brush head.
Figure 3:
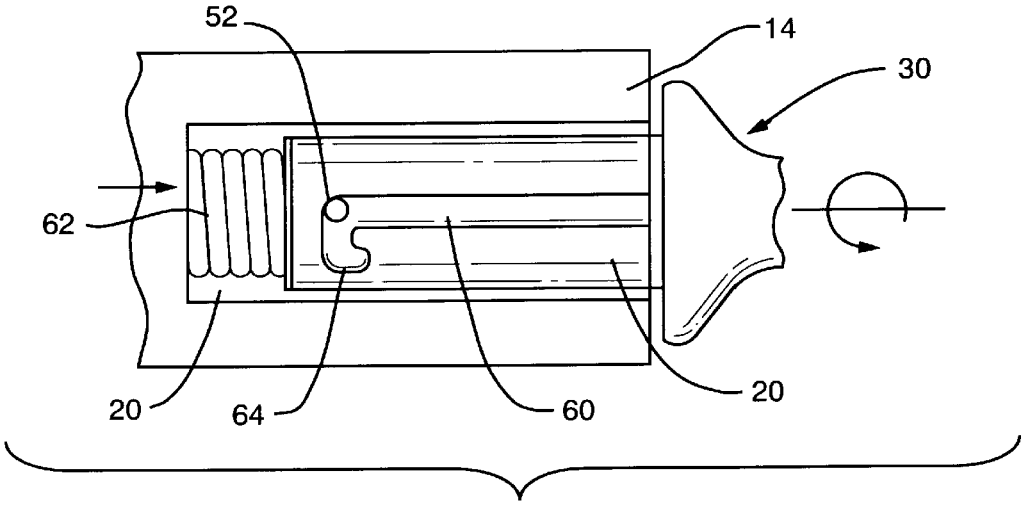
FIG. 3 is a cut away side view of the embodiment of FIG. 2 after insertion of the rod and before rotation and locking of the ball within the retainer.
Figure 4:
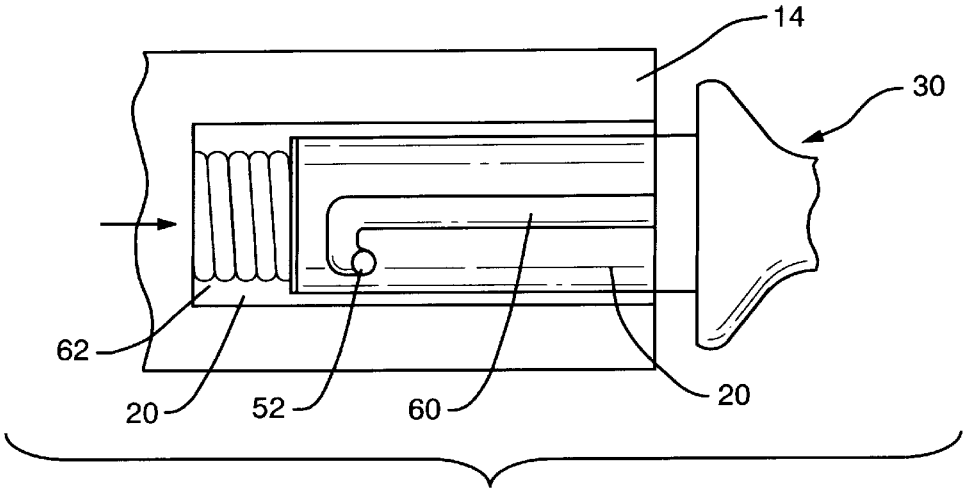
FIG. 4 is a cut away side view of the embodiment of FIGS. 2 and 3 showing the ball locked within the retainer

Referring now to FIGS. 2–4, a cut away view another embodiment of the quick disconnect mechanism 50 of the hairbrush 10 present invention is shown. In this embodiment, the sleeve 22 is eliminated and the base 14 of the brush head 12 includes an opening 20 having a keyway 60 dimensioned to accept a fixed ball 52 mounted in the rod 32 of the brush handle 30. A spring 62 is provided at the end of the opening 20 for urging the ball 52 into a retainer 64, holding the ball in place. Because of the complex shapes of the keyway 60 and retainer 64 within the opening 20, it is preferred that the base 14 of the brush head 12 in this embodiment be manufactured of a molded plastic.

In operation, the brush handle 30 is aligned with the opening 20 in the base 14 of the brush head such that the fixed ball 52 is aligned with the keyway 60, as shown in FIG. 2. The brush handle 30 is then urged towards the brush head such that the ball follows the keyway 60 to its furthest point within the opening 20, as shown in FIG. 3, where the spring 62 exerts a force upon the rod 32 in the direction of the brush handle 30. The brush handle 30 is then rotated and the handle is released, forcing the ball 52 into retainer 64, as shown in FIG. 4.

It is recognized that the embodiment shown in FIGS. 2–4 may be modified to achieve the same result. For example, the spring 62 may be eliminated and the fixed ball 52 equipped with a spring as in the embodiment of FIG. 1. In addition, the ball 52 may be replaced with a fixed post of square or shaped cross section, with the keyway 60 having a corresponding shape.

Figure 5:
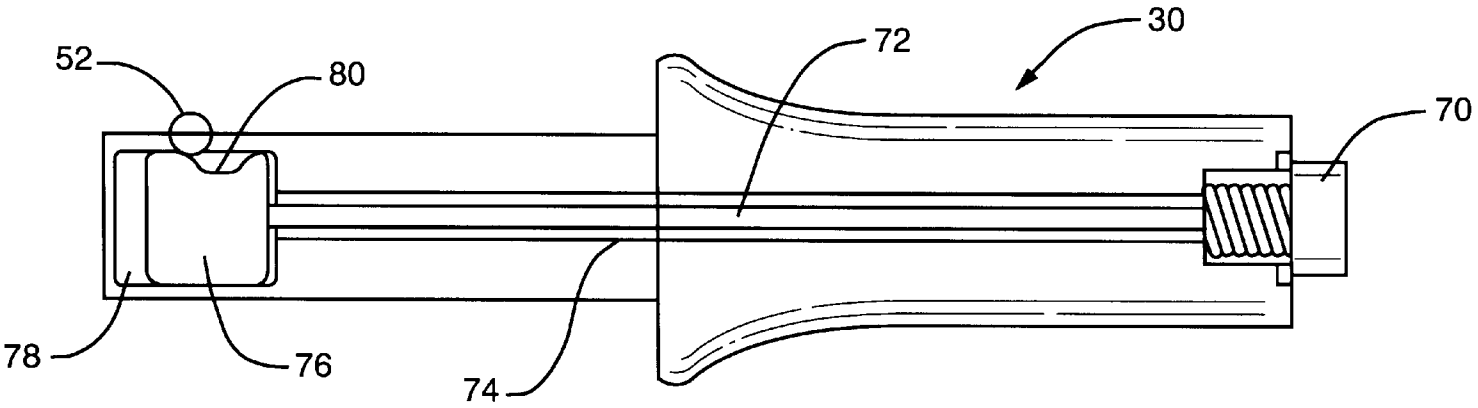
FIG. 5 is a cut away side view of another embodiment of the hairbrush of the present invention having a button actuated quick disconnect mechanism.
Figure 6:
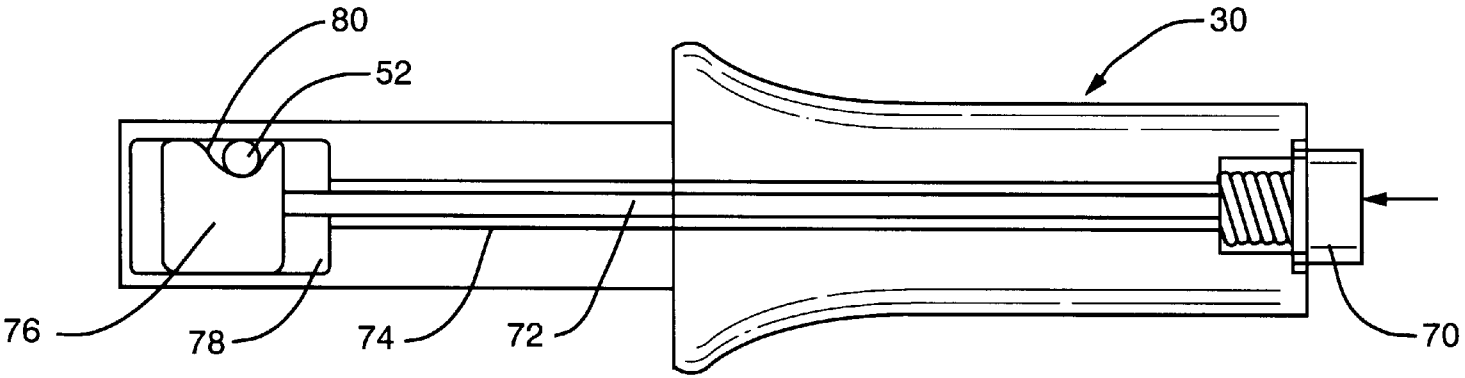
FIG. 6 is a cut away side view of the hairbrush of FIG. 5 with the ball in a retracted position.

Referring now to FIGS. 5 and 6, still another embodiment of the present invention is shown. In this embodiment, a spring loaded button 70 is disposed at the end of the brush handle 30 for actuating a pin 72 that extend through the handle 34, and rod 32 to allow the ball 52 to be engaged and retracted. Pin 72 extends through a pin opening 74 that extends through the handle 34 and rod 32 and attaches to a piston 76. Piston is disposed within a cylinder 78 in the end of the rod 32 and includes shaped notch 80. Shaped notch 80 is dimensioned to cause the ball 52 to extend above the surface of the rod 32 when the button 70 is not engaged, as shown in FIG. 5, and to allow the ball 52 to retract below the surface of the rod 32 when the button is engaged, as shown in FIG. 6. When utilized with the sleeve 22 of FIG. 1, or the keyway 60 and retainer 64 of FIGS. 2–4, this embodiment allows the rod 32 to be withdrawn from the opening 20 with a minimum of force.

Figure 7:
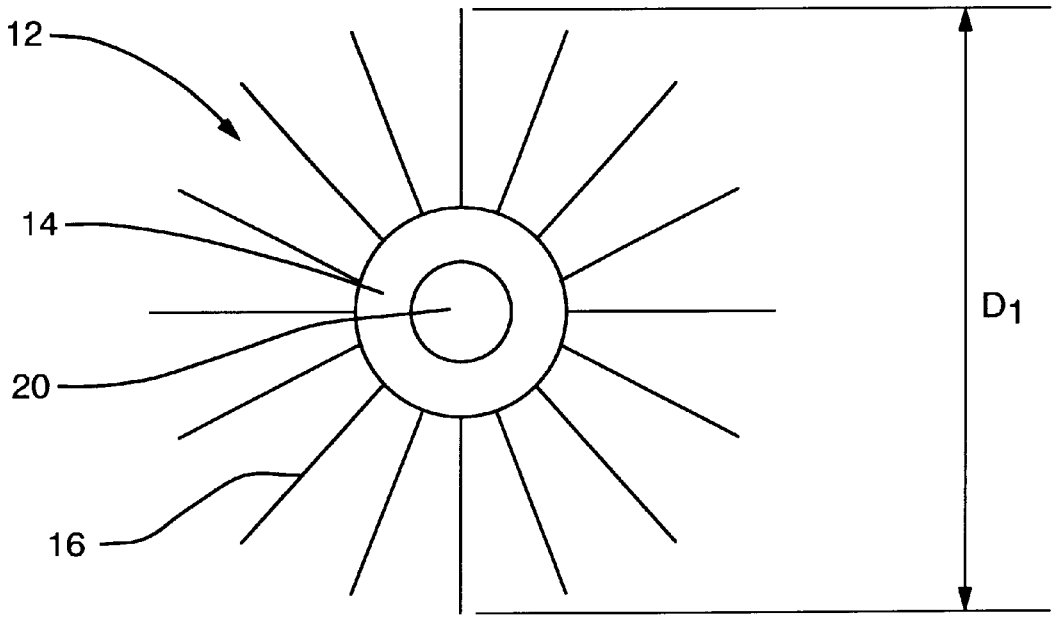
FIG. 7 is an end view of a first brush head of the system of the present invention.
Figure 8:
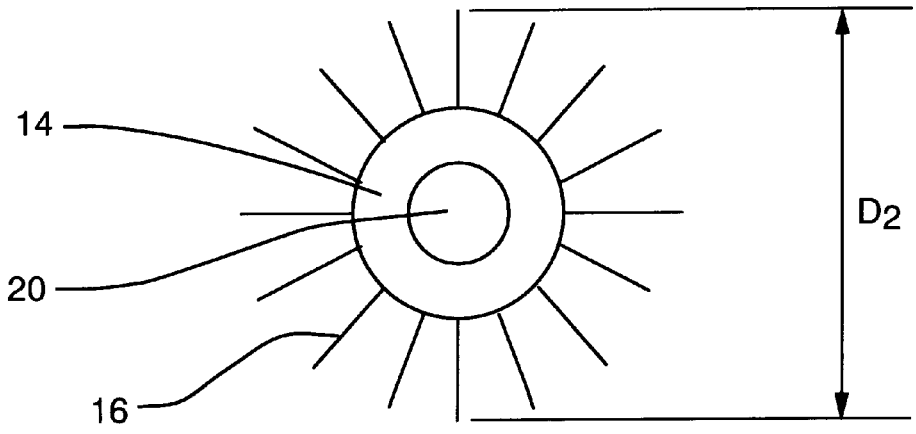
FIG. 8 is an end view of a first brush head of the system of the present invention.

Referring now to FIGS. 7 and 8, two brush heads 12 utilized in the system of the present invention are shown. Each brush head 12 includes an identical base 14 having an opening 20 dimensioned to accommodate the particular embodiment of handle 30 to be utilized. However, each brush head 12 includes bristles 16 that extend a different length from the base 14 of the brush head 16. FIG. 7 shows such a brush head 12 having relatively long bristles 16 resulting in a brush head 12 having a relatively large diameter $D_1$. FIG. 8 shows a brush head 12 having relatively short bristles 16 resulting in a brush head 12 having a relatively small diameter $D_2$. The preferred system includes a plurality of brush heads 12 having bristles of different sizes to form a variety of diameters $D_n$.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A hairbrush comprising:

a brush head comprising a plurality of bristles, said brush head having a handle end into which a substantially cylindrical opening is disposed;

a removable brush handle dimensioned for attachment to said brush head, said removable handle having a brush end and a rod extending from said brush end and dimensioned for insertion within said opening in said brush head; and a quick disconnect mechanism for removably attaching said brush handle to said brush head such that said brush handle may be quickly removed from said brush head;

wherein said rod has a mating surface and wherein said quick disconnect mechanism comprises a ball partially extending from said mating surface of said rod.

2. The hairbrush as claimed in claim 1 wherein said quick disconnect mechanism further comprises a keyway disposed within said opening and terminating in a retainer.

3. The hairbrush as claimed in claim 1 wherein said quick disconnect mechanism further comprises a spring disposed within said rod for exerting an upward spring force upon said ball.

4. The hairbrush as claimed in claim 3 further comprising a sleeve disposed within said opening for receiving said rod.

5. The hairbrush as claimed in claim 4 wherein said sleeve further comprises a hole disposed and dimensioned to receive said ball.

6. The hairbrush as claimed in claim 2 wherein said brush head is substantially cylindrical in shape.

7. The hairbrush as claimed in claim 2 wherein said brush handle is manufactured from wood.

8. A hairbrush system comprising:

a first brush head and a second brush head, said first brush head and second brush head each being substantially cylindrical in shape and each having a handle end into which a substantially cylindrical opening is disposed;

a removable brush handle dimensioned for attachment to said first brush head and said second brush head, said removable handle having a brush end and a rod extending from said brush end, said rod having a mating surface dimensioned for insertion within said opening in said brush head; and a quick disconnect mechanism for removably attaching said brush handle to said first brush head and said second brush head such that said brush handle may be quickly removed from said brush head;

wherein said quick disconnect mechanism comprises a ball partially extending from said mating surface of said rod; and wherein said brush handle may be attached to said first brush head, said first brush head may be used to brush and roll a plurality of stands of hair, said brush handle may be removed from said first brush head and attached to said second brush head, said second brush head may be used to brush and roll a plurality of stands of hair, and said brush handle may be removed from said second brush head.

9. The hairbrush system as claimed in claim 8 wherein said quick disconnect mechanism further comprises a spring disposed within said rod for exerting an upward spring force upon said ball.

10. The hairbrush system as claimed in claim 9 further comprising a first sleeve disposed within said first opening and a second sleeve disposed within said second opening, said first sleeve and said second sleeve being dimensioned to receive said rod.

11. The hairbrush system as claimed in claim 10 wherein said first sleeve and said second sleeve each further comprise a detent disposed and dimensioned to receive said ball.

12. The hairbrush system as claimed in claim 8 wherein a diameter of said first brush head is substantially different from a diameter of said second brush head.

13. The hairbrush system as claimed in claim 12 further comprising a plurality of brush heads dimensioned for releasable attachment to said brush handle.

* * * * *